US012337257B1

(12) United States Patent
Zhang

(10) Patent No.: US 12,337,257 B1
(45) Date of Patent: Jun. 24, 2025

(54) TOY WATER BALLOON

(71) Applicant: Shenzhen Huamingjun Rubber Co., Ltd, Guangdong (CN)

(72) Inventor: Hongjun Zhang, Guangdong (CN)

(73) Assignee: Shenzhen Huamingjun Rubber Co., Ltd, Shenzhen (CN)

( * ) Notice: Subject to any disclaimer, the term of this patent is extended or adjusted under 35 U.S.C. 154(b) by 0 days.

(21) Appl. No.: 18/775,422

(22) Filed: Jul. 17, 2024

(30) Foreign Application Priority Data

Feb. 1, 2024 (CN) ..... 202420254884.2

(51) Int. Cl.

| | |
|---|---|
| ***A63H 33/18*** | (2006.01) |
| ***A63B 39/06*** | (2006.01) |
| ***A63H 27/10*** | (2006.01) |
| ***B65D 43/02*** | (2006.01) |
| ***B65D 45/32*** | (2006.01) |
| *A63B 39/00* | (2006.01) |

(52) U.S. Cl.
CPC ..... *A63H 33/18* (2013.01); *A63B 39/06* (2013.01); *A63H 27/10* (2013.01); *B65D 43/0204* (2013.01); *B65D 45/32* (2013.01); *A63B 2039/003* (2013.01); *A63H 2027/1041* (2013.01)

(58) Field of Classification Search
CPC ..... A63H 27/10; A63H 2027/1041; A63H 2027/1075; A63H 33/18; B65D 43/02; B65D 43/0204; B65D 45/32
See application file for complete search history.

(56) References Cited

U.S. PATENT DOCUMENTS

| | | | | |
|---|---|---|---|---|
| 2,693,292 A * | 11/1954 | Vischer, Jr. | A47J 47/02 | 220/350 |
| 3,893,725 A * | 7/1975 | Coulter | B65F 1/1615 | 24/302 |
| 4,735,338 A * | 4/1988 | Stancil | B65D 45/16 | 215/290 |
| 6,431,385 B1 * | 8/2002 | Palmer | B65D 45/22 | 215/273 |
| 8,678,212 B2 * | 3/2014 | Kim | B65D 41/22 | 215/320 |
| 8,747,933 B1 * | 6/2014 | McGinn | A47J 27/08 | 220/573.1 |
| 2011/0095027 A1 * | 4/2011 | Starr | B65D 51/1605 | 220/846 |
| 2012/0024856 A1 * | 2/2012 | Smyers | A47G 19/02 | 220/345.6 |
| 2013/0118640 A1 * | 5/2013 | Saggio | A63H 27/10 | 141/313 |
| 2015/0201801 A1 * | 7/2015 | Yang | A47J 27/0811 | 220/573.1 |

* cited by examiner

*Primary Examiner* — John A Ricci

(57) ABSTRACT

The present disclosure relates to the technical field of water playing toys, particularly to a toy water balloon, which comprises a flexible shell, a flexible cover and an elastic arm. The flexible shell limits a water storage cavity and an opening connects the water storage cavity and the external space of the flexible shell. The outer contour of the flexible cover is larger than that of the opening to seal the water storage cavity. It is only needed to make the toy water balloon deformation by using the opening to expose the water storage cavity. Which results in higher safety and lower production cost. Compared with the non-magnetic toy water balloon, the flexible cover will stick closely to the inner wall of the water storage cavity so that the toy water balloon disclosed in the present application has good sealing properties.

17 Claims, 8 Drawing Sheets

TOY WATER BALLOON

CROSS REFERENCE TO RELATED APPLICATIONS

The present claims the benefit of Chinese Patent Application No. 202420254884.2 filed on Feb. 1, 2024, the contents of which are incorporated herein by reference in their entirety.

TECHNICAL FIELD

The present disclosure relates to the field of water playing toys, particularly to a toy water balloon.

BACKGROUND TECHNIQUE

The existing toy water balloons can be classified into two sorts: one is a magnetic toy water balloon, the other is a non-magnetic toy water balloon. The magnetic toy water balloons include two shells with magnetic parts, the two shells can be enclosed to limit a water storage cavity. When the two shells are enclosed, the magnetic parts on the two shells can attract each other to avoid the two shells being easily separated. Only in case the toy water balloon hits the player, the two shells will be separated by force to make the player who is hit get wet. Since most of the players of the toy water balloons are children, they may pull and bite the toy water balloons during use. If the magnetic parts fall out when the toy water balloons are pulled or bitten, there is a risk of being swallowed by children. And the magnetic toy water balloons have a high cost because it has multiple magnetic parts.

Non-magnetic toy water balloons generally include two half spheres, the edges of the two half spheres are fastened to define a water storage cavity. One disadvantage of the non-magnetic toy water balloon is that the tightness is relatively poor. The water in the water storage cavity is relatively easy to overflow. In addition, the stability of the connection between the two half spheres of the non-magnetic toy water balloons is also relatively poor. They are easy to be separated before the toy water balloons hit the player. Therefore, the non-magnetic toy water balloons provided poor user experience.

SUMMARY

The embodiment of the present invention aims to provide a toy water balloon, which can effectively avoid water overflow in a water storage cavity on the premise of low production cost.

In one aspect, the present invention discloses a toy water balloon, comprising a flexible shell, the flexible shell limits a water storage cavity and an opening connects the water storage cavity and the outer space of the flexible shell; a flexible cover, the outer contour of the flexible cover is greater than the contour of the opening, the flexible cover is entirely located in the water storage cavity or at least the edge of the flexible cover extends into the water storage cavity and seals the water storage cavity; an elastic arm, the elastic arm is connected to the flexible shell and extends from the edge of the opening to the center of the opening, and the elastic arm is connected to the side of the flexible cover towards an external space; the elastic arm is configured to apply an outward force on the flexible cover so that the edge of the flexible cover sticks closely to the inner wall of the water storage cavity.

Optionally, the elastic arm is integrally formed with the flexible shell, the thickness of the elastic arm is greater than the thickness of the flexible shell.

Optionally, the elastic arm is arranged on the outer side of the flexible shell so that the inner wall of the water storage cavity is a spherical or aspherical streamlined curve surface.

Optionally, an elastic ring surrounding the flexible shell is arranged near the middle of the flexible shell.

Optionally, the elastic ring is integrally formed with the flexible shell and protrudes out the inner wall of the water storage cavity and/or the outer side of the flexible shell.

Optionally, the elastic arm extends on the flexible shell to connect with the elastic ring.

Optionally, the flexible shell comprises an edge part adjacent to the opening, which folds over in a direction away from the water storage cavity.

Optionally, multiple elastic arms are provided and uniformly arranged around the opening.

Optionally, the side of the flexible cover towards the elastic arm is provided with an inserting hole, the side of the elastic arm towards the flexible cover is provided with an inserting column, the inserting column is adapted to the inserting hole to connect the elastic arm with the flexible cover.

Optionally, the side of the flexible shell toward the elastic arm is provided with a first lug boss, the side of the flexible shell facing the elastic arm is provided with a second lug boss, the inserting hole is connected with the end of the first lug boss and the second lug boss.

In the second aspect, the embodiment of the present disclosure provides another toy water balloon, comprising: a flexible shell which limits a water storage cavity and an opening connects the water storage cavity with the outer space of the flexible shell, a connection part is arranged on the flexible shell;

a flexible cover, the outer contour of the flexible cover is greater than the outer contour of the opening, the flexible cover is entirely located in the water storage cavity or at least the edge of the flexible cover extends into the water storage cavity and seals the water storage cavity;

an elastic arm, the elastic arm is arranged on a side of the flexible cover toward an external space and has a connection end; the elastic arm is configured to apply outward force to the flexible cover when the connection end is installed on the connection part, so that the edge of the flexible cover stick close to the inner wall of the water storage cavity.

Optionally, the elastic arm is integrally formed with the flexible cover, the connection part comprises a connecting column protruding on the outer surface of the flexible shell, the connection end is provided with a connection hole, and the connection hole is arranged outside the connecting column.

Compared with the prior art, the toy water balloon provided by the embodiment of the present disclosure has the advantages that: the toy water balloon of the embodiment of the present disclosure comprises a flexible shell, a flexible cover and an elastic arm. The flexible shell limits the water storage cavity. The toy water balloon further comprises an opening connects the water storage cavity and the outer space of the flexible shell. The outer contour of the flexible cover is greater than the contour of the opening. The flexible cover is entirely located in the water storage cavity or at least the edge of the flexible cover extends into the water storage cavity and seals the water storage cavity. The elastic arm is connected to the side of the flexible cover towards an external space. The elastic arm is configured to apply an outward force on the flexible cover so that the edge of the flexible cover sticks closely to the inner wall of the water storage cavity. When water needs to be filled into the water storage cavity, it is only needed to make the toy water balloon deformation so that the water storage cavity can be exposed by the opening. After the toy water balloon hits the target, the toy water balloon will make the water in the water storage cavity overflow from the opening due to the deformation. Compared with the magnetic toy water balloon in the prior art, the toy water balloon of the present disclosure does not need built-in magnetic parts. The safety of the toy water balloon is relatively high and production cost is low. Compared with the non-magnetic toy water balloon in the prior art, the flexible cover of the toy water balloon disclosed by the present application can adhere to the inner wall of the water storage cavity under the action of an elastic arm, so it has good sealing property.

BRIEF DESCRIPTION OF THE DRAWINGS

The technical solution of the present invention will be described in detail in combination with the attached drawings and the following embodiments. Reference is now made to the attached drawings.

Like reference numerals refer to like parts throughout the several views, and in which.

Figure 1:
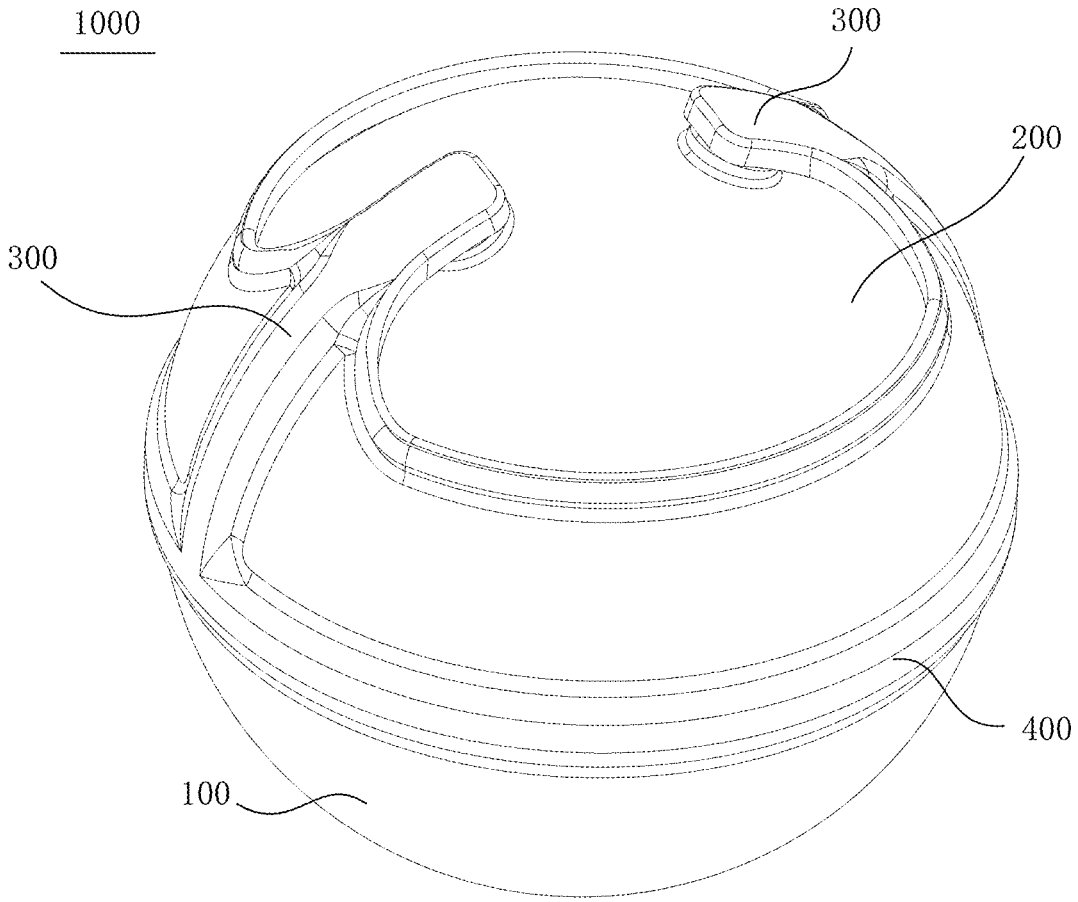
FIG. 1 is a three-dimensional diagram of the toy water balloon provided by the embodiment of the present disclosure.

1000, toy water balloons; 100, flexible shell; 110, water storage cavity; 120, opening; 130, edge part; 140, connection part; 141, connecting column;

200, flexible cover; 210, inserting hole; 220, first lug boss; 230, second lug boss;

300, elastic arm; 310, inserting column; 311, head; 312, body; 313, connection end; 3131, connection hole;

400, elastic ring.

DESCRIPTION OF THE EMBODIMENT

It should be noted that the embodiments in current application and the features in the embodiments may be combined with each other, if there is no conflict. Preferred embodiments of the present disclosure are described in detail in conjunction with the attached drawings.

The embodiment of the present disclosure provides a toy water balloon 1000, as shown in FIG. 1-FIG. 4. The toy water balloon 1000 comprises a flexible shell 100, a flexible cover 200 and an elastic arm 300. The flexible shell 100 limits a water storage cavity 110 and an opening 120 connects the external space of the water storage cavity 110 and the flexible shell 100. The outer contour of the flexible cover 200 is larger than that of the opening 120. The flexible cover 200 is entirely located in the water storage cavity 110 or at least the edge of the flexible cover 200 extends into the water storage cavity 110 and seals the water storage cavity 110. The elastic arm 300 is connected to the flexible shell 100 and extends from the edge of the opening 120 to the center of the opening 120. The elastic arm 300 is connected to the side of the flexible cover 200 towards the outer space. The elastic arm 300 is configured to apply outward force on the flexible cover 200 so that the edge of the flexible cover 200 sticks closely to the inner wall of the water storage cavity 110.

Particularly, since both the flexible shell 100 and the flexible cover 200 are made of flexible materials, the user can make the toy water balloon 1000 produce elastic deformation by applying force to the toy water balloon 1000. In this case, the water storage cavity 110 can be exposed by the opening 120 to facilitate the filling of water into the water storage cavity 110. After filling the water, it is only needed to stop applying force on the toy water balloon 1000, the toy water balloon 1000 will resume its deformation. Since the outer contour of the flexible cover 200 is larger than that of the opening 120, the elastic arm 300 will apply outward force on the flexible cover 200.

Therefore, the flexible cover 200 will stick close to the inner wall of the water storage cavity 110 under the action of the elastic arm 300. So that the water storage cavity 110 can be well sealed to avoid the water leakage in the water storage cavity 110. When the user throws the toy water balloon 1000 out and hits the player, the toy water balloon 1000 will be impacted by external force and produce elastic deformation. In this case, the water storage cavity 110 can be exposed by the opening 120. The water in the water storage cavity 110 will overflow from the opening 120 under the action of external force resulting in the player hit by the toy water balloon 1000 get wet.

It is understood that throw at the player is only the reference play of the toy water balloon. In addition to throw at the player, it is also possible to simply throw the toy water balloon 1000 to the bottom surface, the wall or other places. The embodiment does not limit the application here.

Compared with a magnetic toy water balloon, the toy water balloon disclosed in this embodiment does not require a built-in magnetic component. There is no risk that the magnetic component will fall out of the toy water balloon when the toy water balloon is pulled or bitten, and be swallowed by a child. Since no built-in magnetic component is required, the production cost is also lower than the magnetic toy water balloon. Thus, the toy water balloon 1000 disclosed in this embodiment has higher safety and lower production cost.

Compared with the non-magnetic toy water balloon, the toy water balloon 1000 disclosed in this embodiment has good sealing properties. Particularly, because when the flexible cover 200 shields the opening 120 of the flexible shell 100, the elastic arm 300 apply outward force on the flexible cover 200. So that the flexible cover 200 will stick close to the inner wall of the water storage cavity 110 under the action of the elastic arm 300. So that the water storage cavity 110 can be well sealed to avoid the water leakage in the water storage cavity 110.

Figure 2:
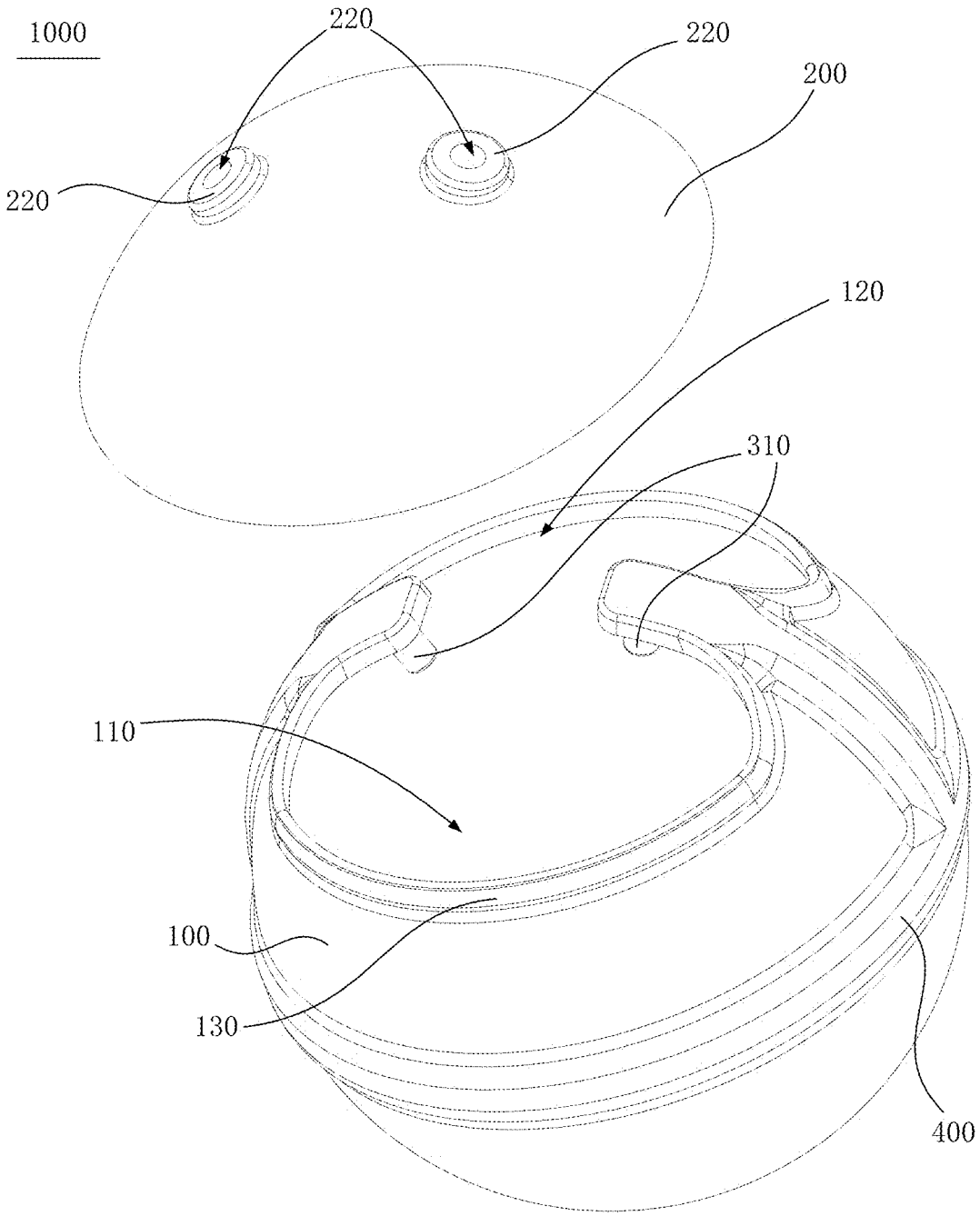
FIG. 2 is the decomposition diagram of the toy water balloon shown in FIG. 1.
Figure 3:
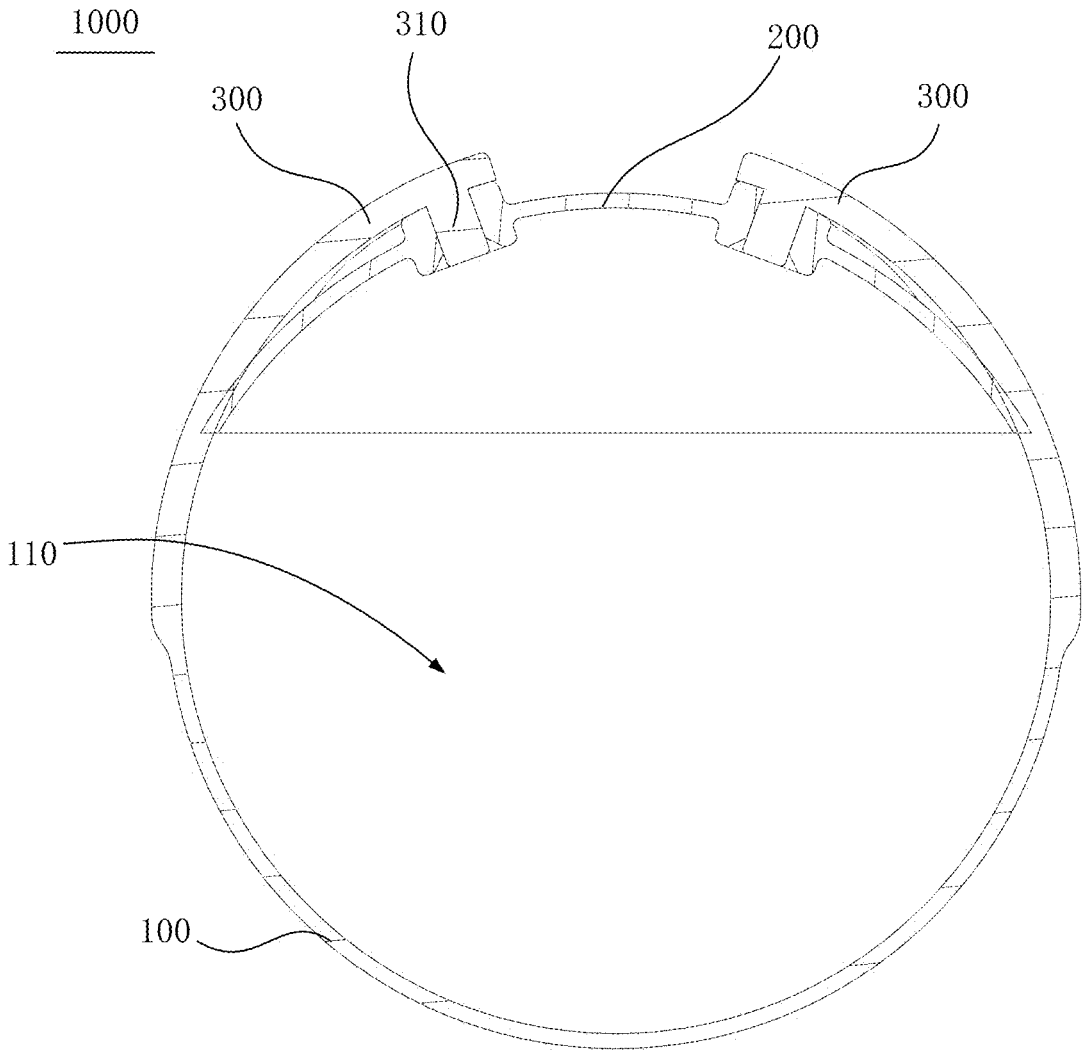
FIG. 3 is a section view of the toy water balloon shown in FIG. 1.
Figure 4:
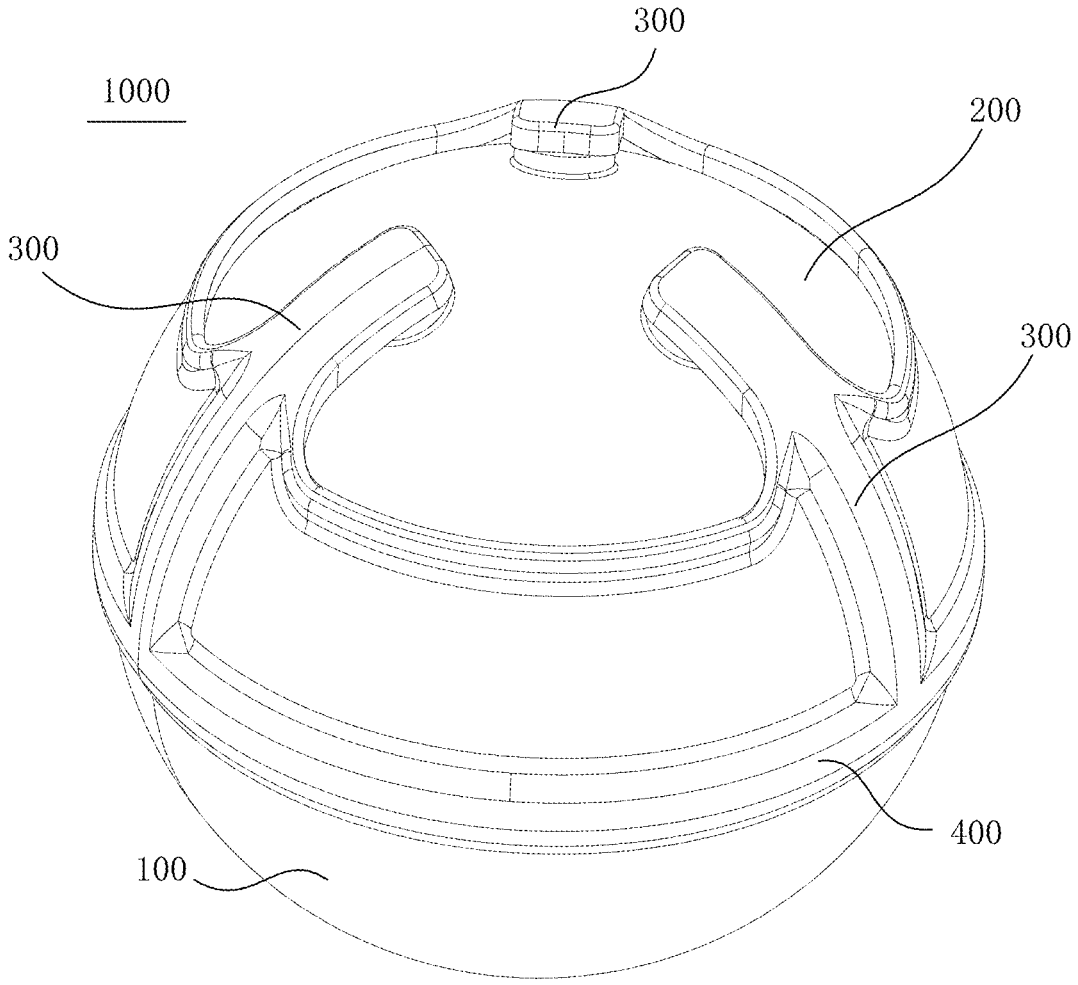
FIG. 4 is a three-dimensional diagram of the toy water balloon provided by another embodiment of the present disclosure.
Figure 5:
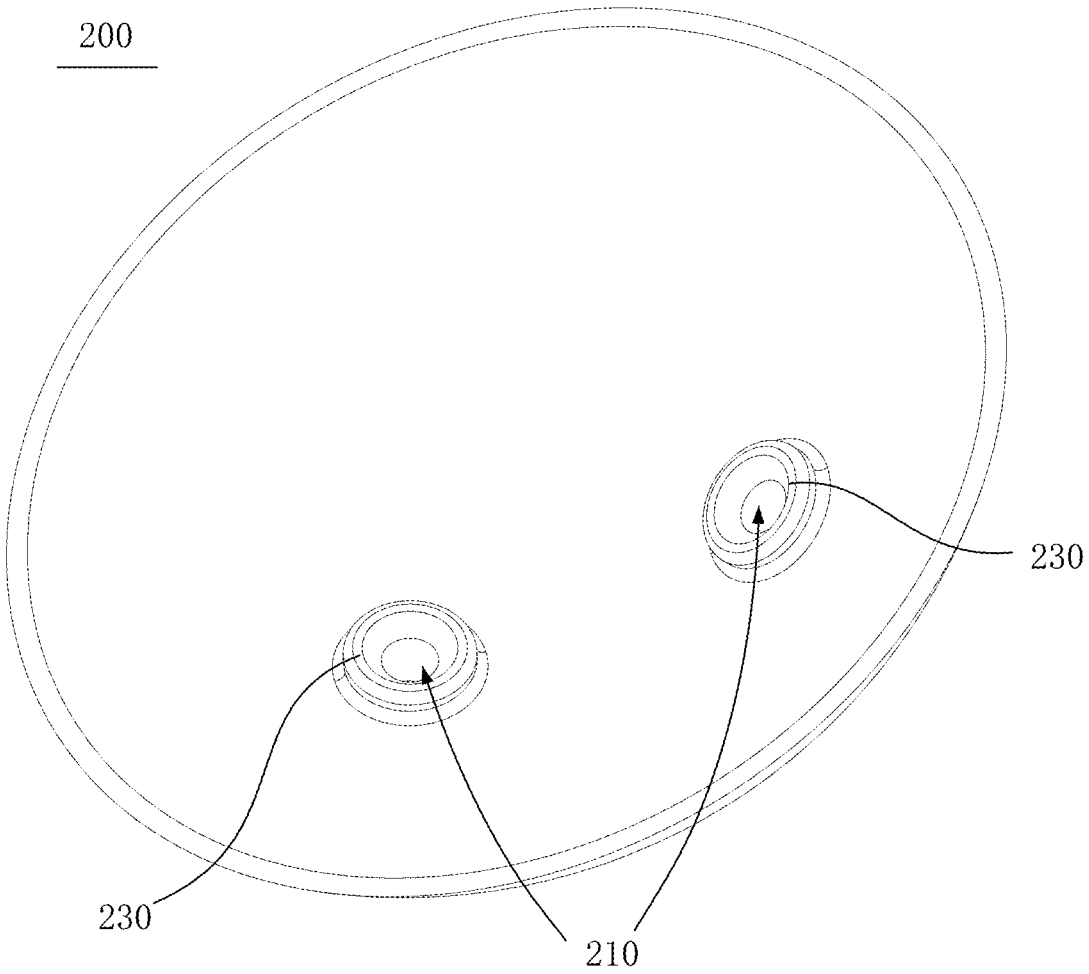
FIG. 5 is a three-dimensional diagram of the flexible cover in the toy water balloon shown in FIG. 1.

Refer to FIG. 1-FIG. 3, in the embodiment, the elastic arm 300 and the flexible shell 100 are integrally formed. The thickness of the elastic arm 300 is greater than that of the flexible shell 100.

Particularly, the elastic arm 300 and the flexible shell 100 integrally formed not only make the toy water balloon 1000 not easy to damage, but also effectively reduce the structural complexity of the toy water balloon 1000. Thus, the production cost of the toy water balloon 1000 is reduced. The thickness of the elastic arm 300 is greater than that of the flexible shell 100, which is conducive to ensuring that the elastic arm 300 provides sufficient force to the flexible cover 200, so that the water storage cavity 110 can be well sealed.

Refer to FIG. 1-FIG. 3, in the embodiment, the elastic arm 300 is arranged on the outer side of the flexible shell 100 so that the inner wall of the water storage cavity 110 is a spherical or aspherical streamlined curve surface.

Particularly, if the elastic arm 300 is arranged in the flexible shell 100, the elastic arm 300 will protrude from the cavity wall of the water storage cavity 110. This will affect the tightness of the flexible cover 200 and the cavity wall of the water storage cavity 110 to a certain extent. Therefore, the elastic arm 300 is arranged on the outer side of the flexible shell 100 in this embodiment to make the inner wall of the water storage cavity 110 a spherical or aspherical streamlined curve surface, and then improve the sealing performance of the flexible cover 200 and the flexible shell 100 when crimped. This effectively prevents the water in the water storage cavity 110 from overflowing before the toy water balloon 1000 hits the player. The user experience is excellent.

Refer to FIG. 1-FIG. 3, in one embodiment, a flexible shell 100 is provided with an elastic ring 400 near the middle and surrounding the flexible shell 100.

Particularly, the elastic ring 400 is used to apply a force on the toy water balloon 1000 after elastic deformation, causing the toy water balloon 1000 back to round. For example, when the user needs to fill water into the water storage cavity 110, the elastic deformation of the toy water balloon 1000 can be generated by applying a force to the toy water balloon 1000. In this case, the water storage cavity 110 can be exposed by the opening 120 to facilitate the filling of water into the water storage cavity 110. If the force applied when filling water is too large, when the user stops applying force to the toy water balloon 1000, the toy water balloon 1000 is difficult to back to round smoothly. Or the process of the toy water balloon 1000 back to round is very slow. By adding the elastic ring 400, the toy water balloon 1000 can be made to round when the user stops applying force to the toy water balloon 1000, and the user experience is excellent.

Refer to FIG. 1-FIG. 3, in one embodiment, the elastic ring 400 is integrally formed with the flexible shell 100, and the elastic ring 400 protrudes out the inner wall of the water storage cavity 110 or the outer side of the flexible shell 100.

Particularly, the elastic ring 400 and the flexible shell 100 can make the toy water balloon 1000 not easy to damage, but also effectively reduce the structural complexity of the toy water balloon 1000, and thus reduce the production cost of the toy water balloon 1000. In the embodiments where the elastic ring 400 only protrudes from the inner wall of the water storage cavity 110, the elastic ring 400 will not be exposed to the outer surface of the toy water balloon 1000, and the visual experience of the toy water balloon 1000 will be better and more aesthetic. In the embodiments where the elastic ring 400 only protrudes on the outer surface of the flexible shell 100, the elastic ring 400 does not compress the space of the water storage cavity 110, allowing the water storage cavity 110 to contain more water. In the embodiment of the elastic ring 400 protrudes from the inner wall of the water storage cavity 110 and the outer surface of the flexible shell 100, the elastic ring 400 will have greater elasticity and can better promote the process of the toy water balloon 1000 back to round.

Refer to FIG. 1-FIG. 3, in one embodiment, the elastic arm 300 extends on the flexible shell 100 to be connected to the elastic ring 400, so that the elastic arm 300 has higher structural strength and can apply more sufficient force on the flexible cover 200, thereby improving the sealing performance of the flexible cover 200 when crimping the flexible shell 100.

Refer to FIG. 1-FIG. 3, in one embodiment, the flexible shell 100 includes an edge part 130 adjacent to the opening 120, and the edge part 130 folds over in a direction away from the water storage cavity 110.

Particularly, if the structural strength of the edge part 130 is too low, the edge part 130 is easily torn during play, resulting in failure of the toy water balloon 1000. In this embodiment, the edge part 130 folds over so that the structural strength of the edge part 130 can be effectively increased to avoid the edge part 130 being torn during play.

To apply a greater and more balanced force on the flexible cover 200, in one embodiment, the elastic arm 300 is provided with plurality of elastic arms. The multiple elastic arms 300 are uniformly arranged on the circumference of the opening 120.

Particularly, increasing the number of elastic arms 300 can apply a greater force on the flexible cover 200. Multiple elastic arms 300 are uniformly arranged on the circumference of the opening 120 can apply a more balanced force on the flexible cover 200. It can be seen that the implementation of this embodiment can improve the sealing performance of the flexible cover 200 when crimped with the flexible shell 100. This will effectively prevent the water in the water storage cavity 110 from overflowing before the toy water balloon 1000 hits the player, and the user experience is excellent. In one embodiment, the elastic arm 300 may be provided with two, three or more.

Refer to FIG. 1-FIG. 6, in one embodiment, the side of the flexible cover 200 toward the elastic arm 300 is provided with an inserting hole 210, and the side of the elastic arm 300 toward the flexible cover 200 is provided with an inserting column 310. The inserting column 310 is adapted to the inserting hole 210 to connect the elastic arm 300 to the flexible cover 200.

Refer to FIG. 1-FIG. 6, in one embodiment, the side of the flexible shell 100 toward the elastic arm 300 is provided with a first lug boss 220, the side of the flexible shell 100 toward the elastic arm 300 is provided with a second lug boss 230. The inserting hole 210 is connected to the end of the first lug boss 220 and the second lug boss 230.

If the structural strength of the connection position between the flexible shell 100 and the elastic arm 300 is too low, the connection position of the flexible shell 100 and the elastic arm 300 will easily break when the toy water balloon 1000 is used, resulting in the failure of the toy water balloon 1000. The first lug boss 220 and the second lug boss 230 can effectively increase the structural strength at the connection position between the flexible shell 100 and the elastic arm 300 and reduce the probability that the connection position between the flexible shell 100 and the elastic arm 300 will break when the flexible shell 100 is in use.

Figure 6:
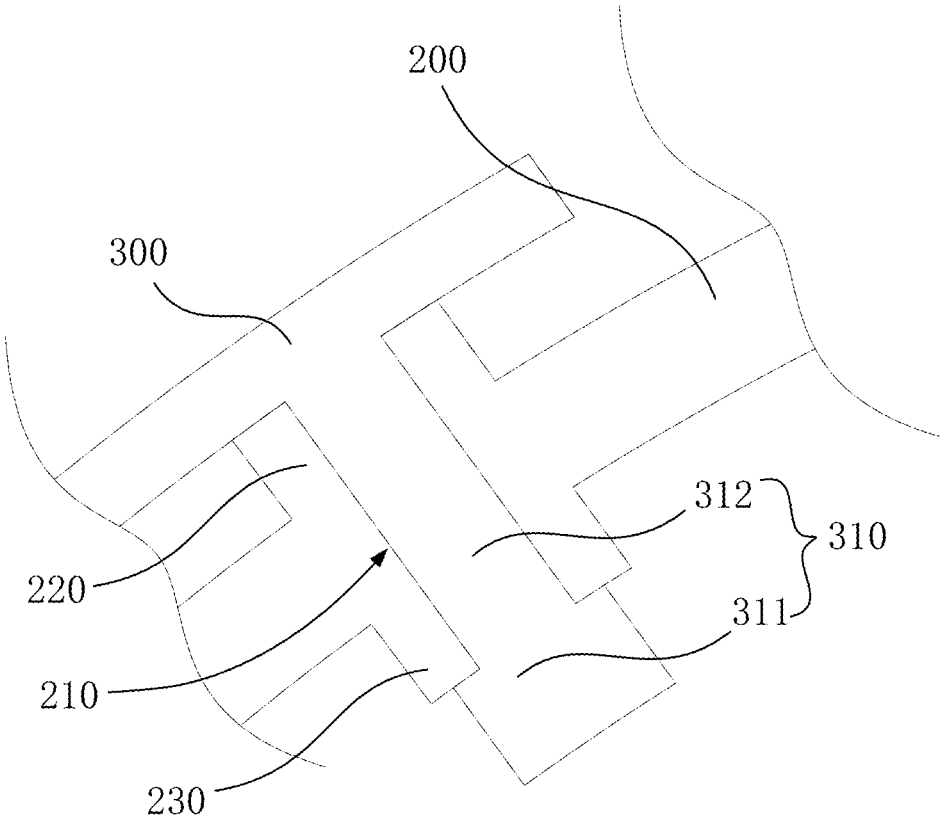
FIG. 6 is a structural diagram of the combination of the inserting column and the inserting hole provided by the embodiment of the present disclosure.

Refer to FIG. 6, in one embodiment, the inserting column 310 comprises a head 311 and a body 312 connected to the head 311. The body 312 is threaded through the inserting hole 210. The head 311 is located on the side of the inserting hole 210 near the water storage cavity 110, and the outer contour of the head 311 is larger than the outer contour of the inserting hole 210 to make the elastic arm 300 and the flexible cover 200 stably clamp together. The connection between the two will not be easily removed, which can effectively improve the stability of the toy water balloon 1000 in use.

In another embodiment, a glue layer is arranged between the inserting column 310 and the inserting hole 210. The elastic arm 300 is stably connected to the flexible cover 200 by means of the glue layer.

Figure 7:
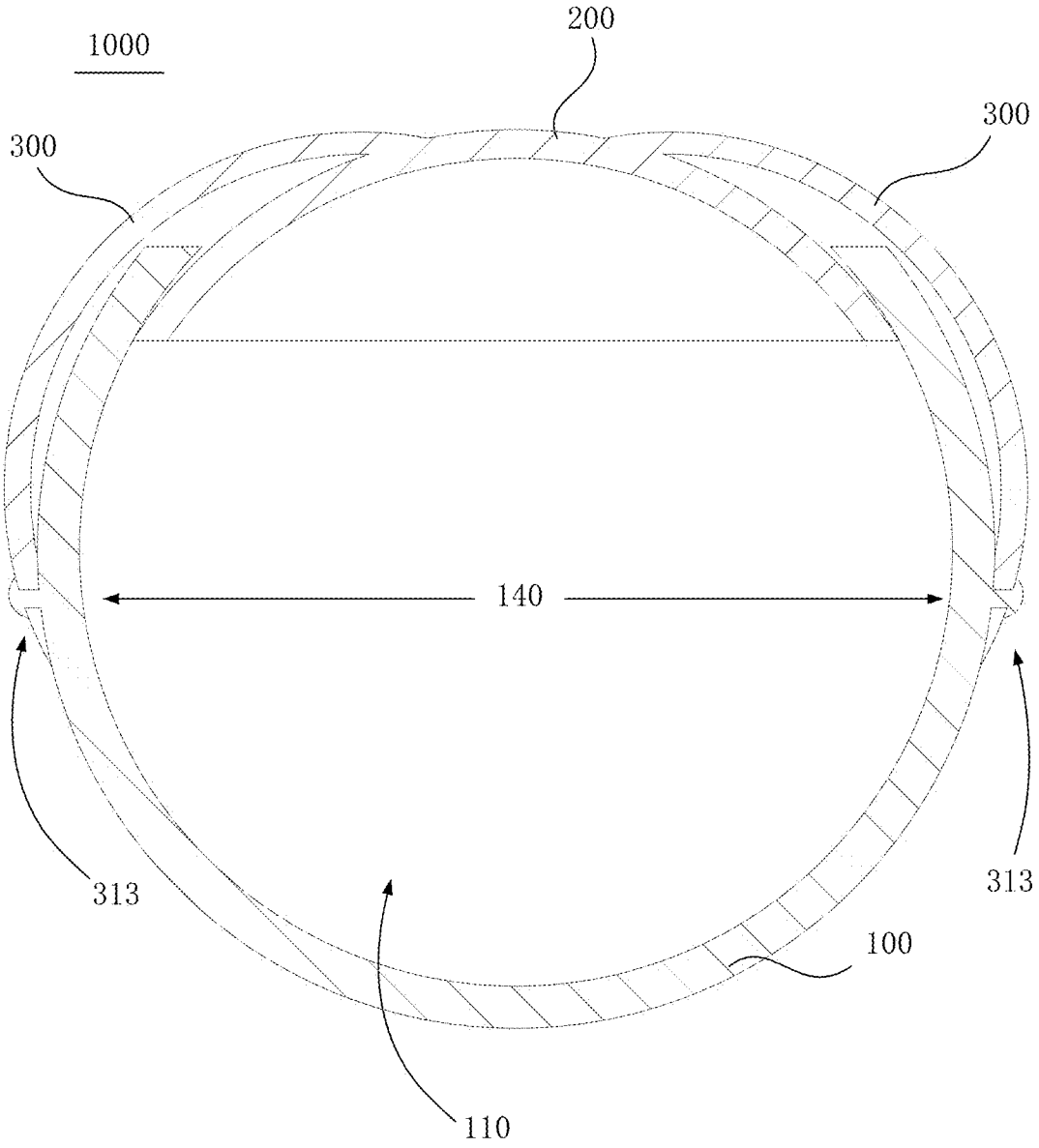
FIG. 7 is a structural schematic diagram of the toy water balloon provided by another embodiment of the present disclosure.
Figure 8:
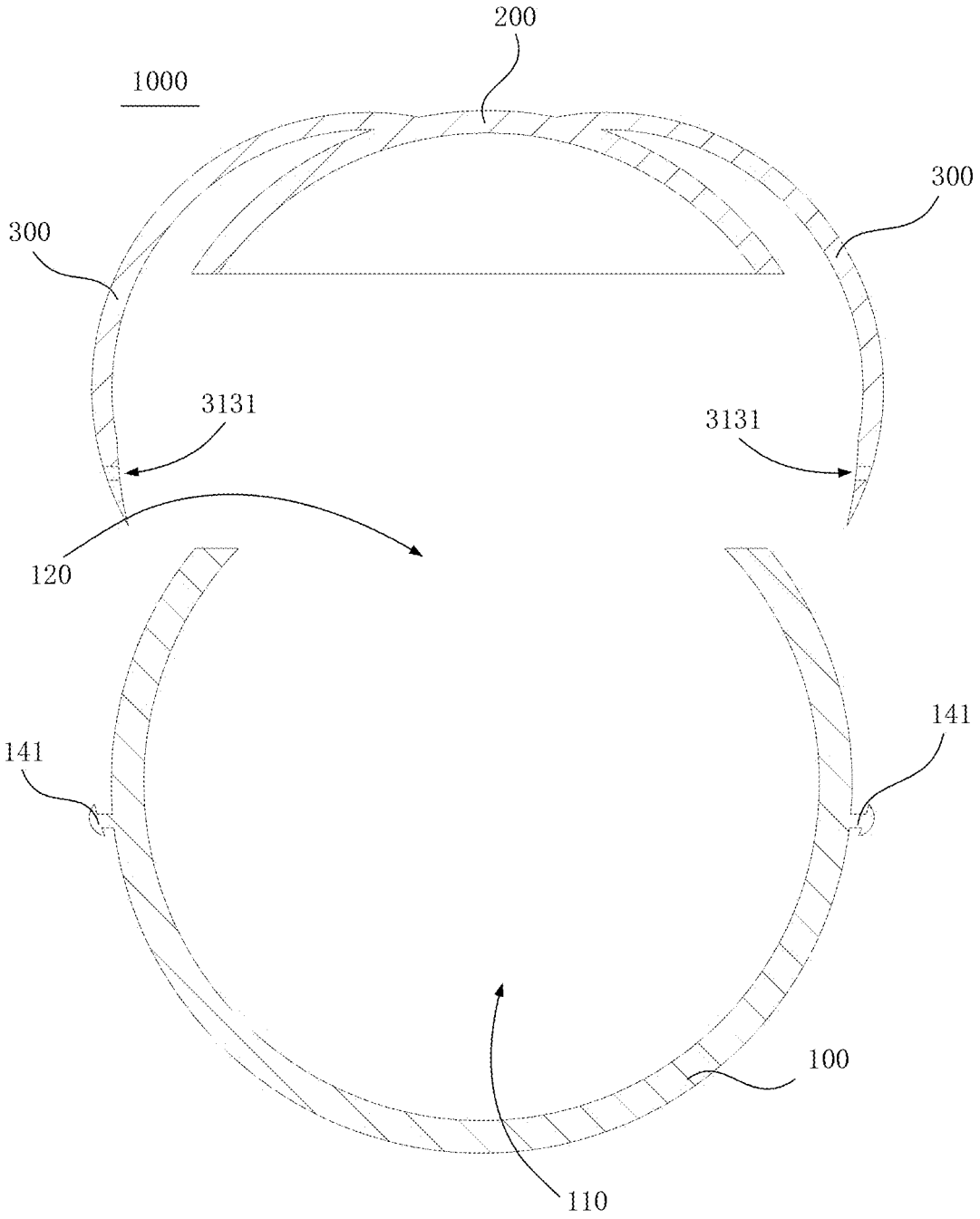
FIG. 8 is a section diagram of the toy water balloon shown in FIG. 7.

The present application further discloses another toy water balloon 1000, as shown in FIG. 7 and FIG. 8. The toy water balloon 1000 comprises a flexible shell 100, a flexible cover 200 and an elastic arm 300. The flexible shell 100 limits a water storage cavity 110 and an opening 120 connects the external space of the water storage cavity 110 and the flexible shell 100. The flexible shell 100 is provided with a connection part 140. The outer contour of the flexible cover 200 is greater than the outer contour of the opening 120, the flexible cover 200 is entirely located in the water storage cavity 110 or at least the edge of the flexible cover 200 extends into the water storage cavity 110 and seals the water storage cavity 110. The elastic arm 300 is arranged on the side of the flexible cover 200 toward an external space and has a connection end 313. The elastic arm 300 is configured to apply outward force on the flexible cover 200 when the connection end 313 is installed on the connection part 140. So that the edge of the flexible cover 200 stick closely to the inner wall of the water storage cavity 110.

Particularly, since both the flexible shell 100 and the flexible cover 200 are made of flexible materials, the user can make the toy water balloon 1000 produce elastic deformation by applying force to the toy water balloon 1000. In this case, the water storage cavity 110 can be exposed by the opening 120 to facilitate the filling of water into the water storage cavity 110. After filling the water, it is only needed to stop applying force on the toy water balloon 1000, and the deformation of the toy water balloon 1000 will resume. Because the outer contour of the flexible cover 200 is larger than that of the opening 120, and the connection end 313 of the elastic arm 300 will apply outward force on the flexible cover 200 when it is installed in the connection part 140. Therefore, the flexible cover 200 will stick closely to the inner wall of the water storage cavity 110 under the action of the elastic arm 300, so that the water storage cavity 110 can be well sealed to avoid the water leakage in the water storage cavity 110. When the user throws the toy water balloon 1000 out and hits the player, the toy water balloon 1000 will be impacted by external force and produce elastic deformation. In this case, the water storage cavity 110 can be exposed by the opening 120, and the water in the water storage cavity 110 will overflow from the opening 120 under the action of external force, resulting in the player hit by the toy water balloon 1000 get wet.

It is understood that throw at the player is only the reference play of the toy water balloon. In addition to throw at the player, it is also possible to simply throw the toy water balloon 1000 to the bottom surface, the wall or other places. The embodiment does not limit the application here.

Compared with a magnetic toy water balloon, the toy water balloon disclosed in this embodiment does not require a built-in magnetic component. There is no risk that the magnetic component will fall out of the toy water balloon when the toy water balloon is pulled or bitten, and be swallowed by a child. Since no built-in magnetic component is required, the production cost is also lower than the magnetic toy water balloon. Thus, the toy water balloon 1000 disclosed in this embodiment has higher safety and lower production cost.

Compared with the non-magnetic toy water balloon, the toy water balloon 1000 disclosed in this embodiment has good sealing properties. Particularly, because when the flexible cover 200 shields the opening 120 of the flexible shell 100, the elastic arm 300 apply outward force on the flexible cover 200. So that the flexible cover 200 will stick close to the inner wall of the water storage cavity 110 under the action of the elastic arm 300. So that the water storage cavity 110 can be well sealed to avoid the water leakage in the water storage cavity 110.

Refer to FIG. 7 and FIG. 8, in one embodiment, the elastic arm 300 and the flexible cover 200 are integrally formed. So that achieving the technical effect of reducing the structural complexity of the toy water balloon 1000 and the production cost of the toy water balloon 1000. The connection part 140 comprises a connecting column 141 protruding from the outer surface of the flexible shell 100, and the connection end 313 is provided with connection hole 3131, a set of connection holes 3131 are arranged outside the connecting column 141.

Particularly, the connection hole 3131 is adapted to the connection column 141 to install the elastic arm 300 on the flexible shell 100, so that there is no need to install glue between the connection end 313 and the connection part 140. This helps to reduce the assembly cost.

It should be understood that the above embodiments are only used to illustrate the technical solution of the present disclosure, and not to restrict it. For a person skilled in the art, the technical solution recorded in the above embodiments may be modified or some of the technical features may be equivalent replaced. All such modifications and substitutions shall fall within the scope of the claims disclosed in the present application.

What is claimed is:

1. A toy water balloon, comprising:

a flexible shell, the flexible shell limits a water storage cavity and an opening connects the water storage cavity and an outer space of the flexible shell;

a flexible cover, an outer contour of the flexible cover is greater than a contour of the opening, the flexible cover is entirely located in the water storage cavity or at least an edge of the flexible cover extends into the water storage cavity and seals the water storage cavity;

an elastic arm, the elastic arm is connected to the flexible shell, and the elastic arm is connected to the side of the flexible cover towards an external space; the elastic arm is configured to apply an outward force on the flexible cover so that the edge of the flexible cover sticks closely to an inner wall of the water storage cavity.

2. The toy water balloon according to claim 1, wherein the elastic arm is integrally formed with the flexible shell, the thickness of the elastic arm is greater than the thickness of the flexible shell.

3. The toy water balloon according to claim 2, wherein the elastic arm is arranged on an outer side of the flexible shell so that the inner wall of the water storage cavity is a spherical or aspherical streamlined curve surface.

4. The toy water balloon according to claim 3, wherein an elastic ring surrounding the flexible shell is arranged near a middle of the flexible shell.

5. The toy water balloon according to claim 3, wherein the flexible shell comprises an edge part adjacent to the opening, which folds over in a direction away from the water storage cavity.

6. The toy water balloon according to claim 3, wherein multiple elastic arms are provided and uniformly arranged around the opening.

7. The toy water balloon according to claim 2, wherein an elastic ring surrounding the flexible shell is arranged near a middle of the flexible shell.

8. The toy water balloon according to claim 2, wherein the flexible shell comprises an edge part adjacent to the opening, which folds over in a direction away from the water storage cavity.

9. The toy water balloon according to claim 2, wherein multiple elastic arms are provided and uniformly arranged around the opening.

10. The toy water balloon according to claim 2, wherein the side of the flexible cover towards the elastic arm is provided with an inserting hole, the side of the elastic arm towards the flexible cover is provided with an inserting column, the inserting column is adapted to the inserting hole to connect the elastic arm with the flexible cover.

11. The toy water balloon according to claim 1, wherein an elastic ring surrounding the flexible shell is arranged near a middle of the flexible shell.

12. The toy water balloon according to claim 11, wherein the elastic ring is integrally formed with the flexible shell and protrudes out the inner wall of the water storage cavity and/or the outer side of the flexible shell.

13. The toy water balloon according to claim 11, wherein the elastic arm extends on the flexible shell to connect with the elastic ring.

14. The toy water balloon according to claim 1, wherein the flexible shell comprises an edge part adjacent to the opening, which folds over in a direction away from the water storage cavity.

15. The toy water balloon according to claim 1, wherein multiple elastic arms are provided and uniformly arranged around the opening.

16. The toy water balloon according to claim 1, wherein the side of the flexible cover towards the elastic arm is provided with an inserting hole, the side of the elastic arm towards the flexible cover is provided with an inserting column, the inserting column is adapted to the inserting hole to connect the elastic arm with the flexible cover.

17. The toy water balloon according to claim 16, wherein an inserting hole on a side of the flexible shell toward the elastic arm is provided with a first lug boss, the side of the flexible shell facing the elastic arm is provided with a second lug boss, the inserting hole is connected with the end of the first lug boss and the second lug boss.

* * * * *